US006202797B1

(12) United States Patent
Skolnick et al.

(10) Patent No.: US 6,202,797 B1
(45) Date of Patent: Mar. 20, 2001

(54) AUTOMATIC PROTECTION OF ELEVATOR MECHANICS

(75) Inventors: Steven M. Skolnick, Simsbury; Chester J. Slabinski, New Hartford; Frank M. Sansevero, Glastonbury, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/383,460

(22) Filed: Aug. 26, 1999

(51) Int. Cl.[7] ..... B66B 13/26
(52) U.S. Cl. ..... 187/317; 127/391; 127/279
(58) Field of Search ..... 187/316, 317, 187/391–394, 399, 279, 280; 340/505, 506, 518, 522, 541, 565

(56) References Cited

U.S. PATENT DOCUMENTS 4,839,631 * 6/1989 Tsuji ..... 340/541
5,283,400 * 2/1994 Leone et al. ..... 187/140
5,443,142 * 8/1995 Glaser ..... 187/316
5,736,692 * 4/1998 Lumme et al. ..... 187/247
6,050,369 * 4/2000 Leone et al. ..... 187/392

FOREIGN PATENT DOCUMENTS

113823 * 12/1990 (JP) ..... 187/391
113824 * 12/1990 (JP) ..... 187/391
310273 * 12/1990 (JP) ..... 187/391
398970 * 4/1991 (JP) ..... 187/391
337480 * 7/1994 (JP) ..... 187/391
219663 * 8/1994 (JP) ..... 187/391
239548 * 8/1994 (JP) ..... 187/391

* cited by examiner

*Primary Examiner*—Jonathan Salata

(57) ABSTRACT

A portable device worn by an elevator mechanic when in the pit of the hoistway or on top of a car will activate sensors disposed on the car so as to cause an emergency stop and warn the mechanic of the elevator's presence. The portable device may be disposed with some form of alarm beneath an emblem, or otherwise, on the uniform of a mechanic.

4 Claims, 2 Drawing Sheets

AUTOMATIC PROTECTION OF ELEVATOR MECHANICS

TECHNICAL FIELD

This invention relates to detecting when an elevator mechanic is in a hoistway either above or below the cab, and causing an emergency stop, if necessary.

BACKGROUND ART

The primary cause of accidental death to elevator mechanics is the severe crushing injury that occurs when the mechanic is working in the pit (below the elevator) or in the overhead (above the elevator) and the elevator moves unexpectedly. Heretofore, mechanics have relied upon use of the elevator controls within the inspection box on the car top to control elevator movement, and thus provide for the mechanic's safety. However, this is not always adequate.

DISCLOSURE OF INVENTION

Objects of the invention include a foolproof detection of a person, such as an elevator mechanic being in a hoistway, providing for automatic stopping of the elevator when a person is in jeopardy, and providing a fail-safe method of assuring elevator mechanic safety.

According to the present invention, elevator mechanics wear a device, the presence of which is detectable by complementary devices disposed at the top and at the bottom of each elevator car. The detectable device may be built into the standard mechanic uniform, and the uniform may have a distinguishing feature to identify the fact that such a device is present in the uniform. The uniform may also have the capability to respond to the presence of the elevator so as to warn the mechanic. In accordance further with the invention, sensing of the mechanic safety device will perform an emergency stop of the elevator.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
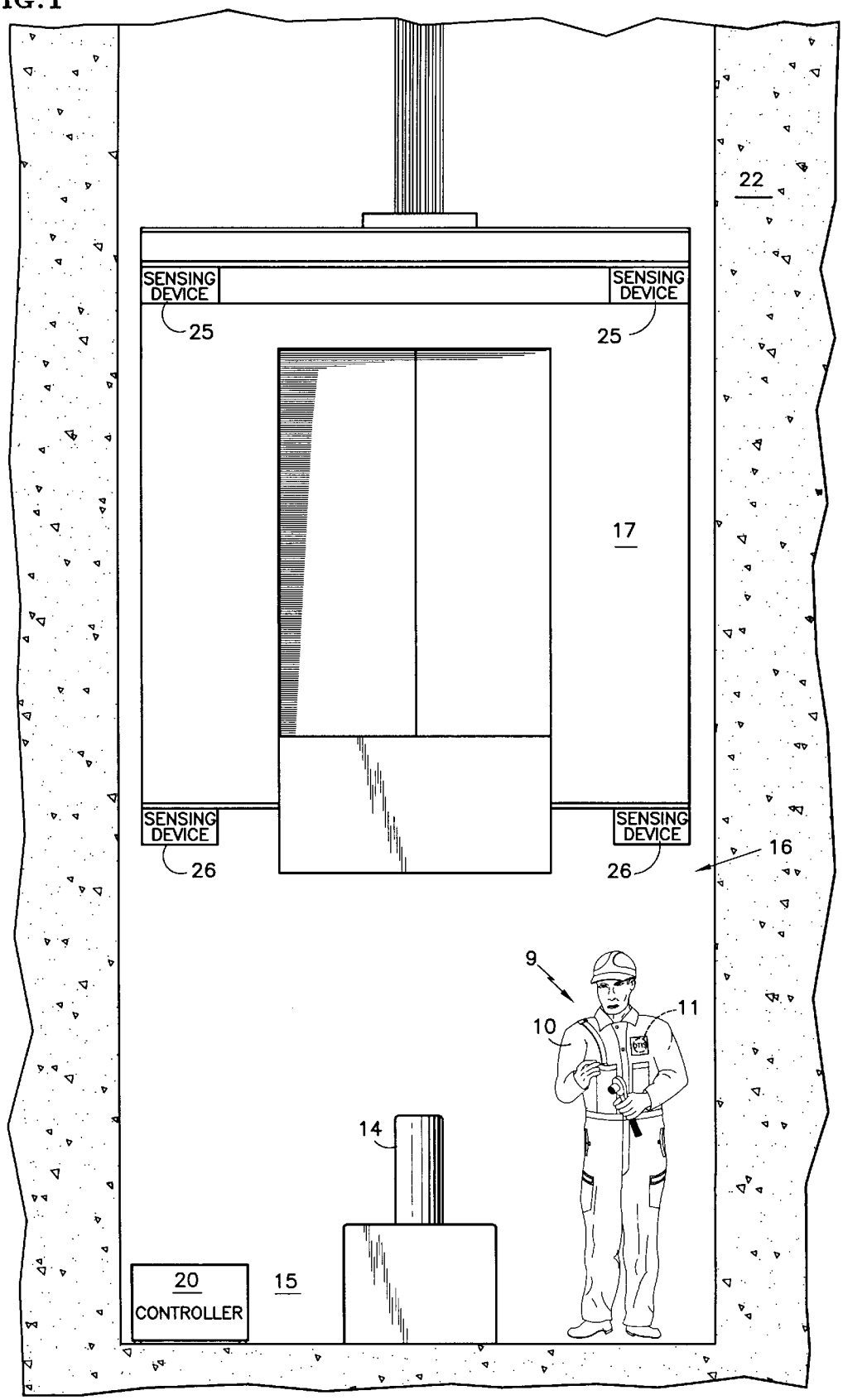
FIG. 1 is a simplified, stylized illustration of an elevator hoistway utilizing the invention.

Referring to FIG. 1, an elevator mechanic 9 is wearing a uniform 10 having a portable device 11, described more fully hereinafter, which may be disposed beneath an emblem. The mechanic 9 is standing next to a car buffer 14, in the pit 15 of an elevator hoistway 16, within which an elevator 17 travels vertically to provide service to passengers. A controller 20 may be disposed within the pit 15, or elsewhere within the building 22, such as in a machine room at the top of the hoistway, in any conventional fashion. In accordance with the invention, a plurality of sensing devices 25, 26 are disposed at the top and the bottom, respectively, of the elevator car 17.

The device 11 may comprise a transmitter powered by a battery or any other conventional portable powered device, in which case the sensors 25, 26 need only be receivers capable of receiving a signal transmitted from the device 11 whenever it is in the vicinity of the sensors 25 or 26, and the sensors are turned on. On the other hand, the sensors 25, 26 may be transponders which transmit an inquiry and will receive a reply, in which case the device 11 may comprise a passive radio frequency identification device (RFID) of a conventional sort, or it may comprise an active transmitter or transponder. The person may also be carrying an alarm, discernible by the mechanic 9 to warn him of the car's presence, such as by vibrating, buzzing, chirping or presenting a steady or flashing light, such as from an LED. The sensors 25, 26, in that case, will activate the alarm by transmitting a signal.

Figure 2:
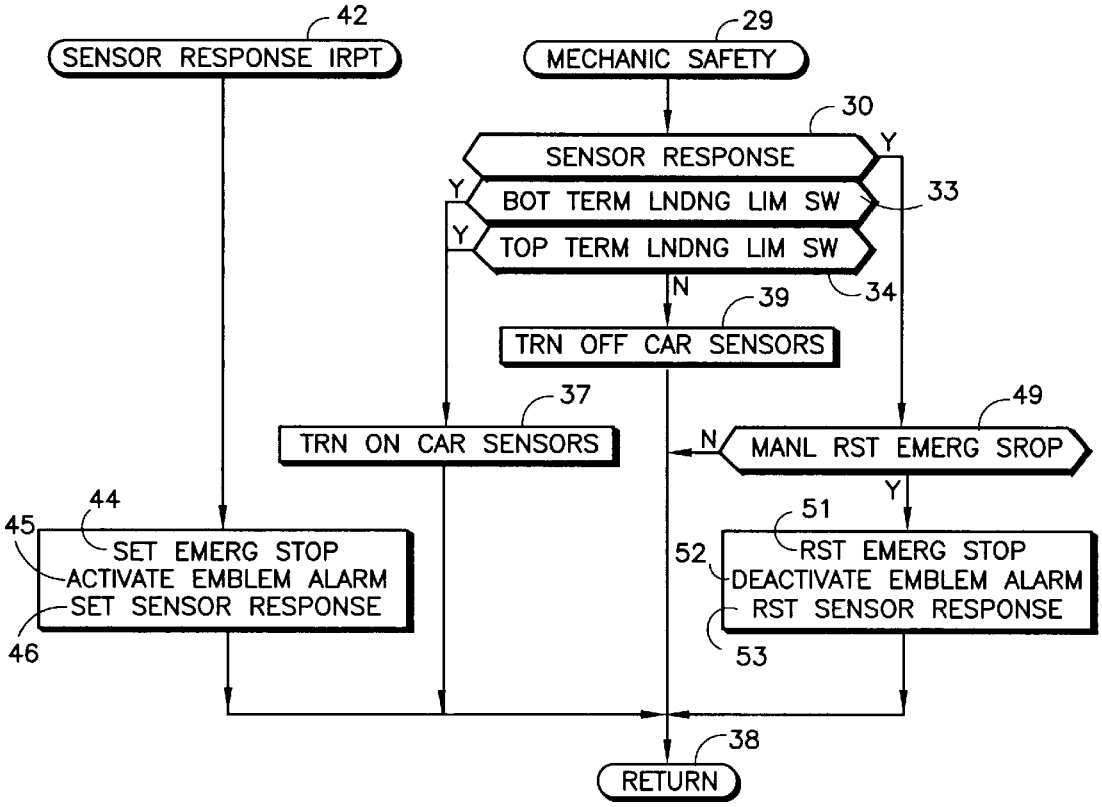
FIG. 2 is a simplified, high level flow diagram of functions which may be performed in accordance with the invention.

Apparatus disposed at any conventional part of the elevator system, such as within the controller 20, may activate and monitor the sensors, stop the elevator when appropriate, and warn the mechanic. In FIG. 2, a mechanic safety functional routine is reached through an entry point 29, and a first test 30 determines if a local sensor response flag (described more fully hereinafter) has been set or not. In the general case, it will not have been, so a negative result of test 30 reaches a test 33 to see if the elevator has activated the bottom terminal landing limit switches. If not, a test 34 determines if the elevator has activated the top terminal landing limit switches. If either of the bottom or the top landing limit switches have been activated, an affirmative result of one of the tests 33, 34 will reach a step 37 to turn on the car sensors 25, 26. If desired, the test 33 may separately turn on the car sensors 26 at the bottom of the car, and the test 34 may separately turn on the switches 25 on the top of the car, in any use of the present invention. Then, other programming is reverted to through a return point 38. Once the car sensors are turned on, if there is no mechanic in the pit, subsequent passes through the routine of FIG. 2 will find negative result of test 30 and an affirmative result of one of the tests 33, 34, thereby reaching the step 37 to redundantly turn on the car sensors. This will continue until the car moves so that the terminal landing limit switches are no longer activated. When that occurs, a negative result of test 30, 33, and 34 will reach a step 39 to turn off the car sensors. Of course, in any implementation of the invention, the car sensors could be left on at all times.

If the elevator is either at the top or the bottom of the landing so that the car sensors are turned on and there is a mechanic 9 either on top of the car or in the pit, the portable device 11 may cause a response in the car sensors 25, 26. When that occurs, that will cause a sensor response interrupt at a point 42 which reaches a step 44 to set emergency stop (which will interrupt the safety chain and cause the elevator to undergo an emergency stop), a step 45 to activate an emblem alarm (which is assumed to be present on the uniform of the mechanic 9, such as where an emblem may be located above one of the shirt front pockets), and a step 46 to set the sensor response flag which is tested in test 30, as described hereinbefore. Under this condition, the car will be at a stop and the alarm will be activated. In subsequent passes through the routine of FIG. 2, test 30 will be affirmative reaching a test 49 to determine if a manual reset of emergency stop has occurred, such as by having the mechanic move an emergency stop reset switch. If not, other programming is reached through the return point 38. Eventually, the mechanic or other personnel may physically reset the emergency stop, so that an affirmative result of test 49 will reach a step 51 to reset the emergency stop, thereby reengaging the safety chain, and allowing the elevator to run, a step 52 to deactivate the emblem alarm in the uniform of the mechanic 9, and a step 53 to reset the sensor response flag. Then other programming is reached through the return point 38. In a subsequent pass through the routine of FIG. 2, test 30 will be negative, but until the elevator moves, one of the tests 33, 34 will be affirmative. Therefore, step 37 will redundantly turn on the car sensors (they not having been shut off yet), and other programming reached through the return point 38. When the elevator finally is moved away from either terminal landing, then a pass through the routine of FIG. 2 will find all three tests 30, 33, and 34 negative, thereby reaching the step 39 to turn off the car sensors. At this point, normal elevator operation has resumed.

The foregoing is exemplary merely of functions which may be performed in order to utilize the present invention. Various alternative ways of utilizing the invention may be practiced with conventional implementation.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator car safety system for use with an elevator car that is moveable vertically within the hoistway of a building, comprising:

one or more sensors disposed on the top of said elevator car and one or more sensors disposed at the bottom of said elevator car;

at least one portable device, each portable device to be w by a person entering said hoistway, each portable device, when worn by a person disposed in said pit or on top of said car capable of inducing a response in one of said sensors; and means responsive to a response induced in one of said sensors to cause an emergency stop of said elevator.

2. A system according to claim herein each said portable device is disposed on an elevator mechanic uniform.

3. A system according to claim 1 further comprising:

at least one alarm to be worn by said person in a manner to be discernible by a person wearing said uniform; and means responsive to a response induced in one of said sensors for activating said alarm.

4. A system according to claim 3 wherein each said alarm is disposed on an elevator mechanic uniform.

* * * * *